US008408958B2

(12) United States Patent
Benham

(10) Patent No.: US 8,408,958 B2
(45) Date of Patent: Apr. 2, 2013

(54) PIVOTING FIN WITH SECUREMENT

(76) Inventor: Roger A. Benham, San Diego, CA (US)

( * ) Notice: Subject to any disclaimer, the term of this patent is extended or adjusted under 35 U.S.C. 154(b) by 217 days.

(21) Appl. No.: 12/986,562

(22) Filed: Jan. 7, 2011

(65) Prior Publication Data

US 2011/0171862 A1 Jul. 14, 2011

Related U.S. Application Data

(60) Provisional application No. 61/282,260, filed on Jan. 8, 2010.

(51) Int. Cl.
*B63B 1/00* (2006.01)
*B63B 35/81* (2006.01)

(52) U.S. Cl. ..... 441/79; 441/74

(58) Field of Classification Search ..... 114/127–143, 114/152; 441/74, 79

See application file for complete search history.

(56) References Cited

U.S. PATENT DOCUMENTS

| | | | | |
|---|---|---|---|---|
| 731,227 | A | 6/1903 | Royse | |
| 3,516,100 | A | 6/1970 | Ellis | |
| 3,972,300 | A | 8/1976 | Adamski | |
| 4,686,922 | A | 8/1987 | Burroughs | |
| 4,923,427 | A | 5/1990 | Roland | |
| 5,273,472 | A | 12/1993 | Skedeleski et al. | |
| 5,664,979 | A * | 9/1997 | Benham | 441/79 |
| 5,813,890 | A * | 9/1998 | Benham | 441/79 |
| 6,244,921 | B1 * | 6/2001 | Pope | 441/79 |
| 6,752,674 | B2 * | 6/2004 | Jolly | 441/79 |
| 2004/0248482 | A1 * | 12/2004 | Larkin | 441/79 |

FOREIGN PATENT DOCUMENTS

| | | |
|---|---|---|
| DE | 2738070 | 3/1979 |
| EP | 0264279 | 4/1988 |
| FR | 2639018 | 5/1990 |
| WO | WO 88/09286 | 12/1988 |
| WO | WO 91/17080 | 11/1991 |

OTHER PUBLICATIONS

US 5,622,134, 04/1997, Kelsey (withdrawn)

* cited by examiner

*Primary Examiner* — Stephen Avila
*Assistant Examiner* — Anthony Wiest
(74) *Attorney, Agent, or Firm* — Welsh Flaxman & Gitler LLC

(57) ABSTRACT

A pivoting fin used to control the movement of a surfboard. The pivoting fin is provided with a rotatable hinge allowing the fin to rotate in the "roll" axis of the surfboard. The rotatable hinge is inserted into base position which in turn is secured to the underside of the surfboard.

17 Claims, 8 Drawing Sheets

PIVOTING FIN WITH SECUREMENT

CROSS-REFERENCE TO RELATED APPLICATIONS

The present invention claims the benefit of the filing date of U.S. provisional patent application Ser. No. 61/282,260, filed Jan. 8, 2010.

FIELD OF THE INVENTION

The present invention relates to a pivoting fin for use with a surfboard.

BACKGROUND OF THE INVENTION

Many different fin designs for surfboards have been presented, including the use of a single fin, twin fins, tri-fins, and quad fins. Many efforts have been made to change and improve the riding characteristics of surfboards by adding channels, cutaways, troughs, or other hydrodynamic changes to the bottom surface of the boards. There has also been the use of pivoting fins that rotate in the "yaw" axis similar to a rudder on a boat in an attempt improve the turning characteristics of surfboards. Our experience has shown that there is greater promise in increasing the performance and maneuverability of a surfboard by using a pivoting fin that has a limited degree of rotation in the "roll" axis of the surfboard, acting on the same axis as the ailerons on an airplane. This type of fin is described in U.S. Pat. Nos. 5,664,979 and 5,813,890 which are incorporated by reference in their entirety.

An obstacle to delivering a pivoting fin to the surfing public has been the difficulty of making a pivoting mechanism that is both hydrodynamic and strong enough to handle the cantilevered impact loads encountered in surfing. Also, there is a general objection by the surfing community to the extra bulk of the pivoting mechanism and the perceived hydrodynamic drag.

The benefits of the present invention are the ability to produce a pivoting mechanism that is reliably secured to the board, strong enough to handle the expected loads caused by water impacting the fin and the board, aesthetically pleasing, and provide a lower level of hydrodynamic drag.

All of these features are important in creating an improved means of divergence and improving water sports skills and equipment testing and design, in particular for the sport of surfing. This all adds to more challenges and conveniences for the consumer.

SUMMARY OF THE INVENTION

The present invention is directed to a high performance surfboard fin which may at least partially overcome at least one of the abovementioned disadvantages or provide the consumer with a useful or commercial choice.

More specifically, the present invention is directed to a pivoting fin including a rotatable hinge directly inserted into a base portion. The rotatable hinge is secured to the fin and the base portion is secured to a standard mounting device attached to the underside of the surfboard. When the surfer shifts his weight to the right or left, while surfing, the surfboard will turn either right or left resulting in the pivoting of the fin in the proper direction due to the rotation of the rotatable hinge.

With the foregoing in mind, the present invention in one form, resides broadly in a pivoting surfboard fin with structural advantages and a securement feature for locking the fin into place while at the same time allowing the fin to rotate freely within a specified range.

BRIEF DESCRIPTION OF THE DRAWINGS

Various embodiments of the invention will be described with reference to the following drawings, in which.

DETAILED DESCRIPTION OF THE PREFERRED EMBODIMENT

Figure 1A:
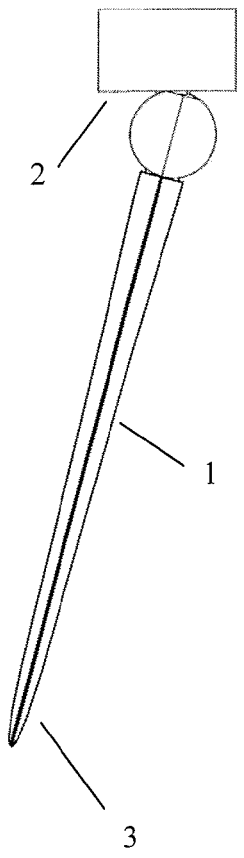
FIGS. 1A, 1B and 1C show front views of the surfboard fin in three positions, turning left, going straight, and turning right respectively.
Figure 1B:
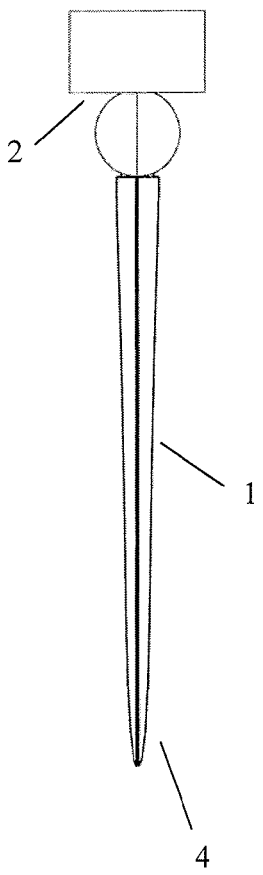
Figure 1C:
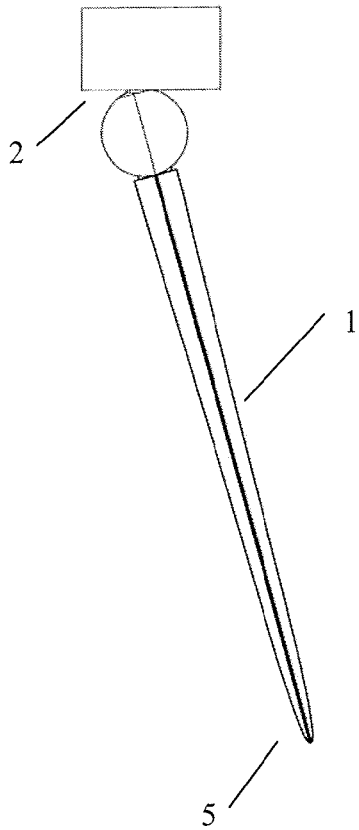

FIGS. 1A, 1B and 1C show front views of the pivoting surfboard fin 1 in the perspective of a person positioned in front of the board, with the board coming toward him. More specifically, FIG. 1A shows the position of the fin when turning left. FIG. 1B shows the position of the fin when going straight. FIG. 1C shows the position of the fin when turning right. The pivoting surfboard fin 1 is secured to the bottom deck 2 of the surfboard. In these views the fin freely pivots in a direction dependant on the direction of the turn. The fin could also include a spring-like bias mechanism (not shown) to dampen the rotating motion of the fin.

As shown in FIG. 1A, when the surfer shifts his weight to the right, the board would turn to the right resulting in the movement of the fin 1 to the right position 3. When, as shown in FIG. 1B the board is going straight, the fin 1 is generally in the center position 4 if there is a center bias mechanism (not shown). When, as shown in FIG. 1C the board turns left responsive to the surfer shifting his body to the left, the fin 1 would rotate to the left position 5 turning the board to the left.

The limited free moving rotation of the fin 1 loosens the board in the roll-axis enabling quicker and more responsive rail-to-rail transitions. Because surfing primarily occurs on the rails of the surfboard, the surfer is moving over the water either on the front-side or back-side rail position. One can get a particularly strong sense of this rail-to-rail transition with snowboarding, where you never traverse on the "flat" portion of the snowboard. In surfing, the only time you are riding on the "flat" portion of the board is when you are riding straight in on the mush (a noticeably awkward, imbalanced, and boring type of surfing). The fin 1 of the present invention is a ridged control surface with limited rotation that allows the board to quickly transition to the real performance part of surfing that occurs on the front-side and back-side rails.

When moving across the face of a wave, one is riding either in the front-side or back-side rail position. In this situation, the fin kicks over, projecting the fin more "normal" (perpendicularly) into the face of the wave. This improves the grip of the board into the face of the wave. Because more fin surface area is projected into the face of the wave a smaller rotatable fin can do the work of a larger fixed fin. The net effect is more speed and control in steep sections of the wave.

During a steep bottom turn, the fin 1 kicks over projecting more ridged fin surface area into the water to counteract the force of the turn. The increase in surface area can be calculated with basic trigonometry. Again, a smaller rotatable fin does the work of a larger fixed fin and the net effect is more speed, control and drive.

This action of the fin provides three benefits, including:

1. The pivoting action of fin reduces the resistance to the roll-axis of the board producing quicker rail-to-rail turns.
2. By projecting the fin more normal to the surface of the water, the pivoting fin increases the amount of fin surface area projected into the water during turns, thereby reducing the surface area of the fin required to turn the board.
3. On the face of wave, the fin kicks over into face of the wave, thereby providing more effective area, resulting in more fin surfaces areas projected into the water, again, utilizing a fin having a relatively small surface area.

Figures 2A, 2B, 2C:
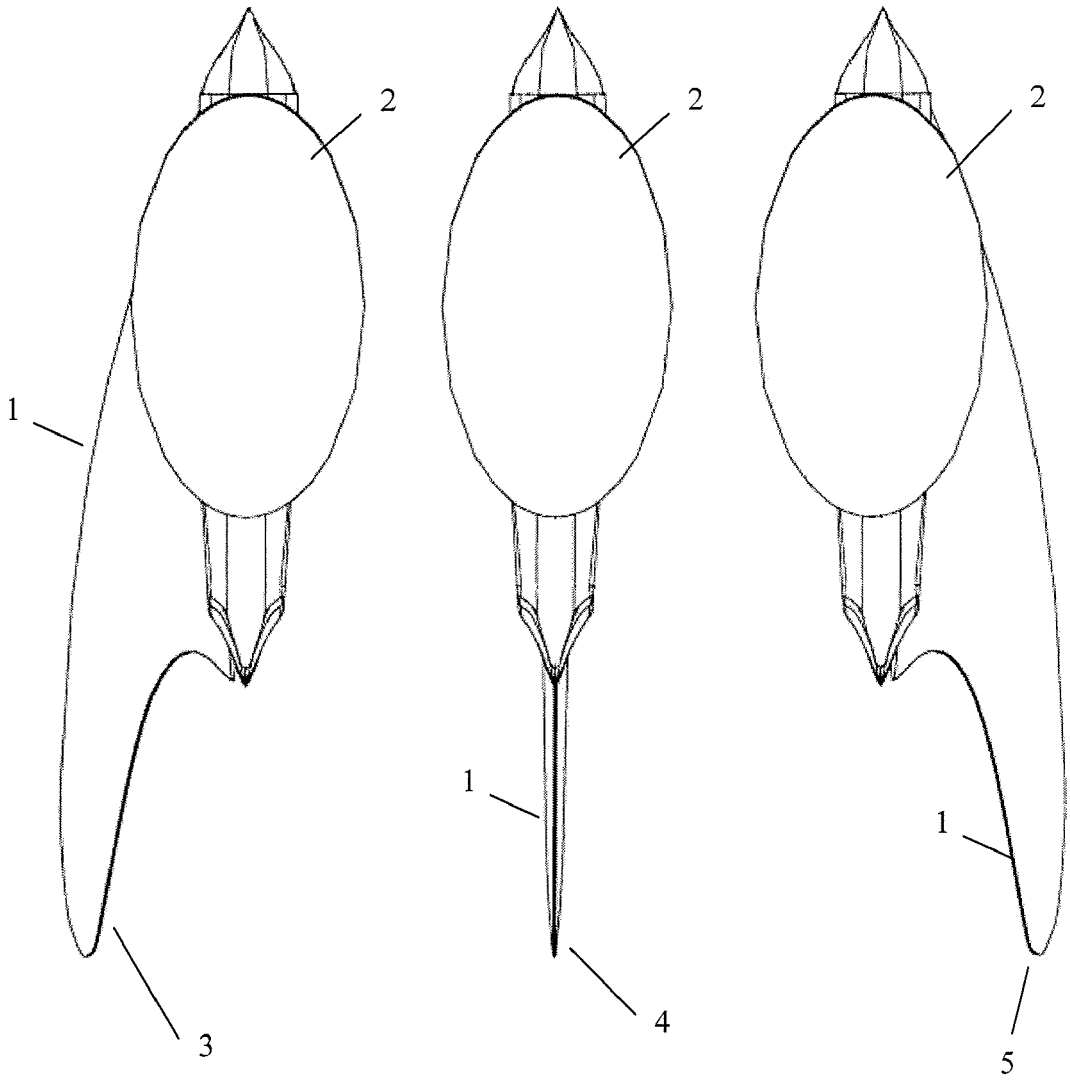
FIGS. 2A, 2B and 2C show top views of the surfboard fin from the perspective of a person standing (riding) a surfboard, turning left, going straight, and turning right respectively.

FIGS. 2A, 2B and 2C show top views of the surfboard fin from the perspective of a person standing on top of the surfboard (the surfer) with the fin in three positions, turning left, going straight, and turning right. The pivoting surfboard fin 1 is secured to the underside surface of the surfboard 2. In these views the fin 1 freely pivots, in some cases with a spring-like bias (bias mechanism not shown), in a direction dependent on the surfer shifting his or her weight to the left or right, resulting in a left or right turn.

As shown in FIG. 2A, when the board turns right, the fin rotates to the right as noted by numeral 3. When, as shown in FIG. 2B the board is going straight the fin is generally in the center position 4, depending if there is center bias (not shown). When, as shown in FIG. 2C the board turns to the left based upon the shift of the surfer's eight to the left, the fin rotates to the left as noted by numeral 5.

Figure 3:
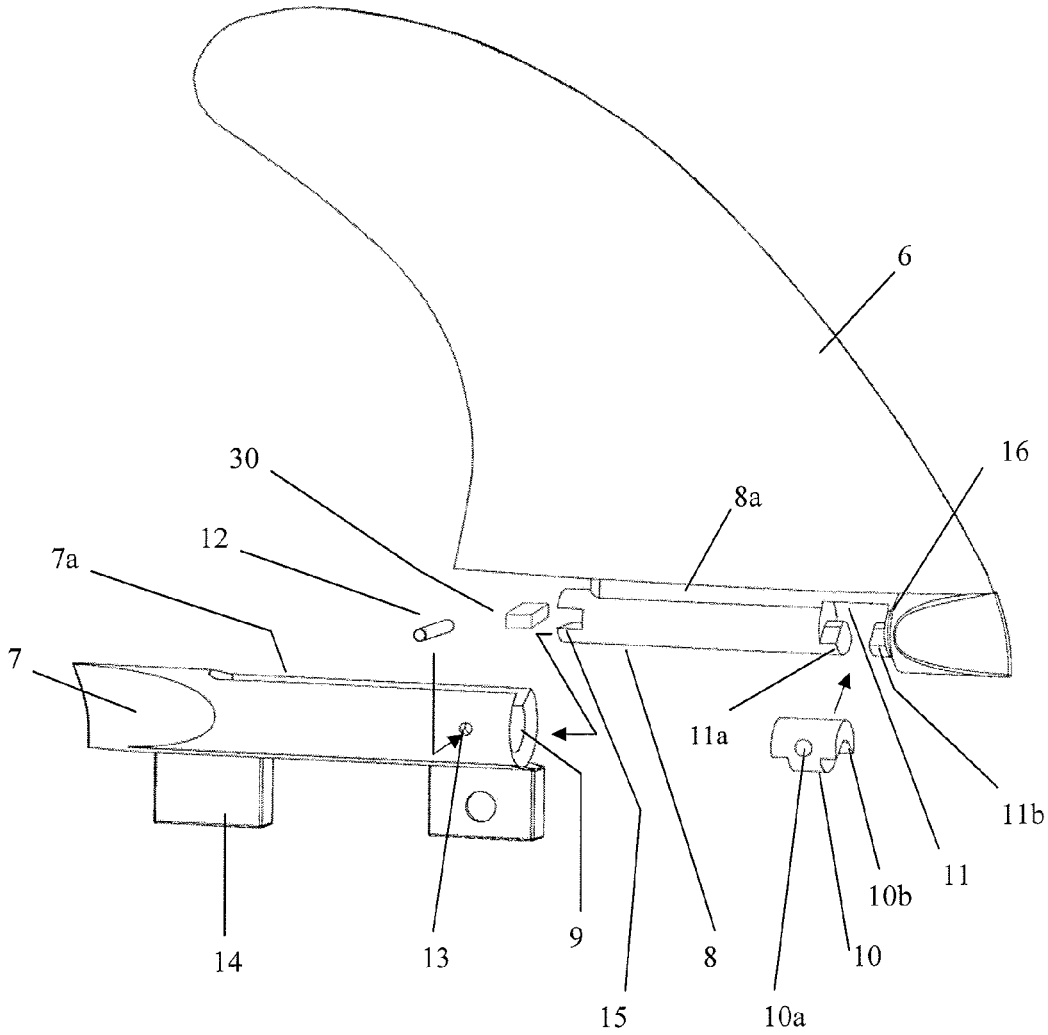
FIG. 3 shows an exploded view of the fin assembly including a side pin having a lateral axis and a pin-bushing.

FIG. 3 shows an exploded view of the fin assembly using a "pin-bushing" means of securement to a mounting system. In this embodiment the two main parts of the assembly are shown, including a fin portion 6 and a hollow base portion 7. The fin portion 6 includes a round cylindrical hinge 8 inserted into a base hinge opening 9 of the base portion 7. The fin portion 6 is secured to the base portion 7 by a close tolerance fit that structurally connects the two components together while allowing the fin portion 6 to freely rotate within the hollow base portion 7, similar to the hinge of a door. This is facilitated by the hinge being provided with a longitudinal projection 8*a* sliding into the slot 7*a* of the base portion 7. In this embodiment, a separate pin-bushing 10 is provided in a hollowed-out section 11 of the cylindrical hinge 8. The pin-bushing 10 is provided with a slot 10*b* extending the length of the pin-bushing 10. Both sides of the hollowed-out section 11 are provided with projections 11*a* and 11*b*, which are located within the slot 10*b*, when the pin-bushing 10 is inserted therein. Projection 11*a* is fixedly attached to the cylindrical hinge 8, and projection 11*b* is fixedly attached to a bearing area 16 of the fin 6. After the pin-bushing 10 is placed in the hollowed-out section 11, the assembly, comprising the fin portion 6, the pin-bushing 10, and the cylindrical hinge 8, is pushed inside of the base hinge opening 9 of the base portion 7. One end of the cylindrical hinge 8 is provided with a spring bushing slot 15 that is designed to accommodate an elastomeric material 30 to add a dampening or bias to the rolling or rotating action of the fin portion 6. The assembly is then secured together by a fastener, such as pin 12 having a lateral axis driven in through a side hole 13 in the base portion 7 that is perfectly aligned to line with a hole 10*a* in the pin-bushing 10. Holes 10*a* and 13 as well as pin 12 having a lateral axis can be threaded to assist in inserting the pin 12 having a lateral axis through hole 13 and into hole 10*a*.

The mechanism of securing the fin portion 6 to the base portion 7, with a fixed pin-bushing 10, as shown in FIG. 3, provides a structurally advantageous mechanism to handle the expected forces, and at the same time provides a hydrodynamically beneficial joining method. The pin 12 having a lateral axis can be in the form of any type of pin, dowel, or fastener, to provide a securing and compression force to hold the assembly together, including, but not limited to a threaded fastener, rivet, pan-head or button head fastener, or a specially formed tee-headed screw or fastener. In FIG. 3 the base portion 7 is shown configured with a Fin Control System (FCS) style mounting system 14.

Figure 4:
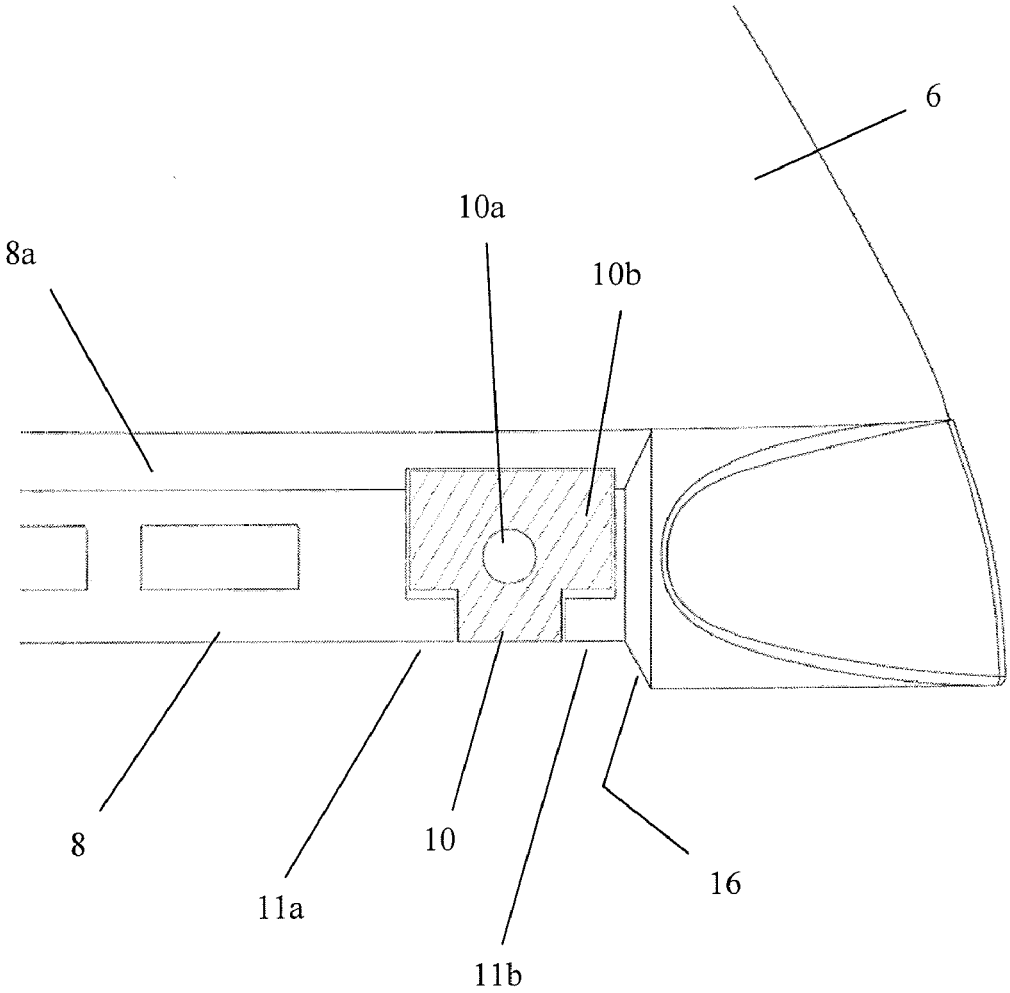
FIG. 4 shows details of the pin-bushing mechanism.

FIG. 4 shows additional details of the pin-bushing 10 mechanism including a side view of the fixed pin-bushing 10, the side hole 13, and the bearing area 16 where the fin portion 6 butts up to the base portion 7 when the two components are assembled.

Figure 5:
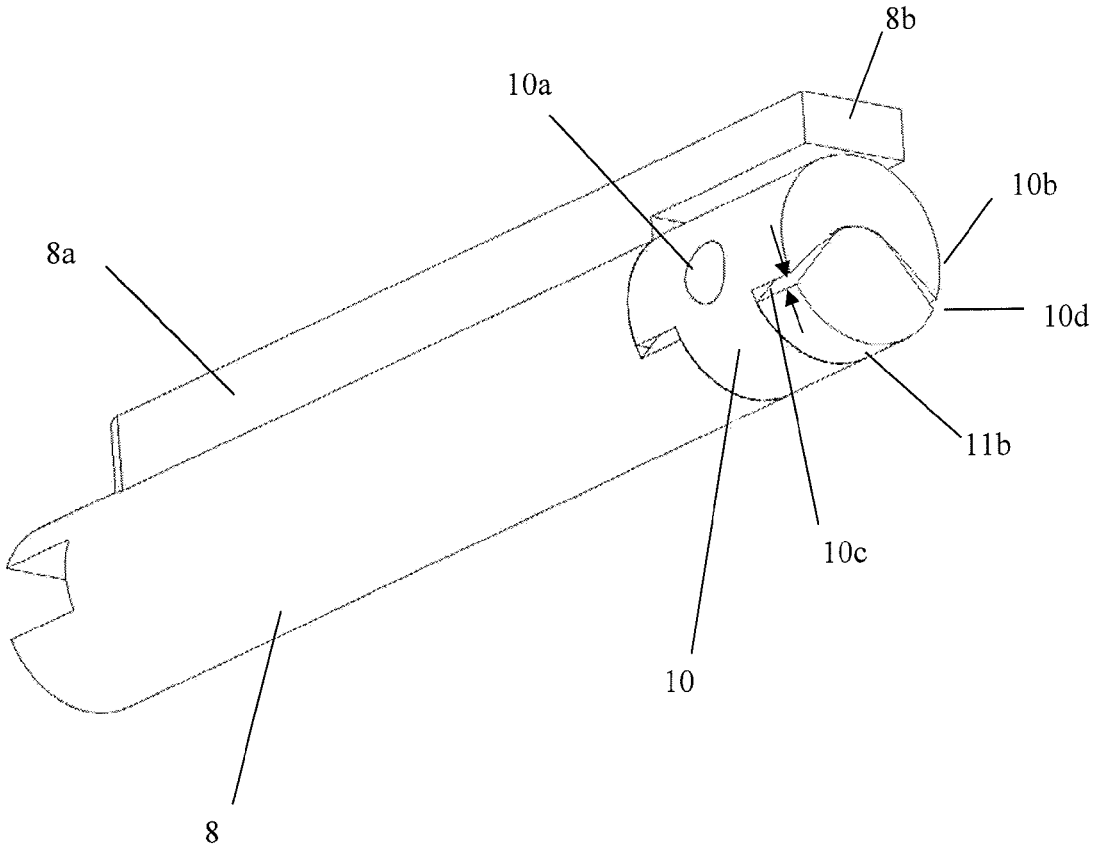
FIG. 5 shows a detail of the limiting and dampening feature of the pin-bushing.

FIG. 5 shows a view of the cylindrical hinge 8 and the pin-bushing 10 with the fin portion 6 omitted. In this view a section has been sliced at the point shown as 8*b* just immediately behind the bearing area 16 as shown in FIG. 4. The purpose of showing this sectioned view is to illustrate how one of the projections 11*b* provided within the hollowed-out section 11 of the cylindrical hinge 8 meshes with the slot 10*b* of the pin-bushing 10. The overlapping affect, which is provided on both sides of the pin-bushing 10, helps prevent the cylindrical hinge 8 from becoming dislodged from the hinge opening 9 when the hinge 8 is inserted into the hinge opening 9, and serves as a limiting and dampening function by making contact at the two extreme rotation directions by the contact at the clearance areas shown at 10*c* and 10*d*. The pin-bushing 10 is comprised of an elastomeric rubber-like material which would help dissipate the impact energy of the fin portion 6 as it swings from on side to the other.

Figure 6:
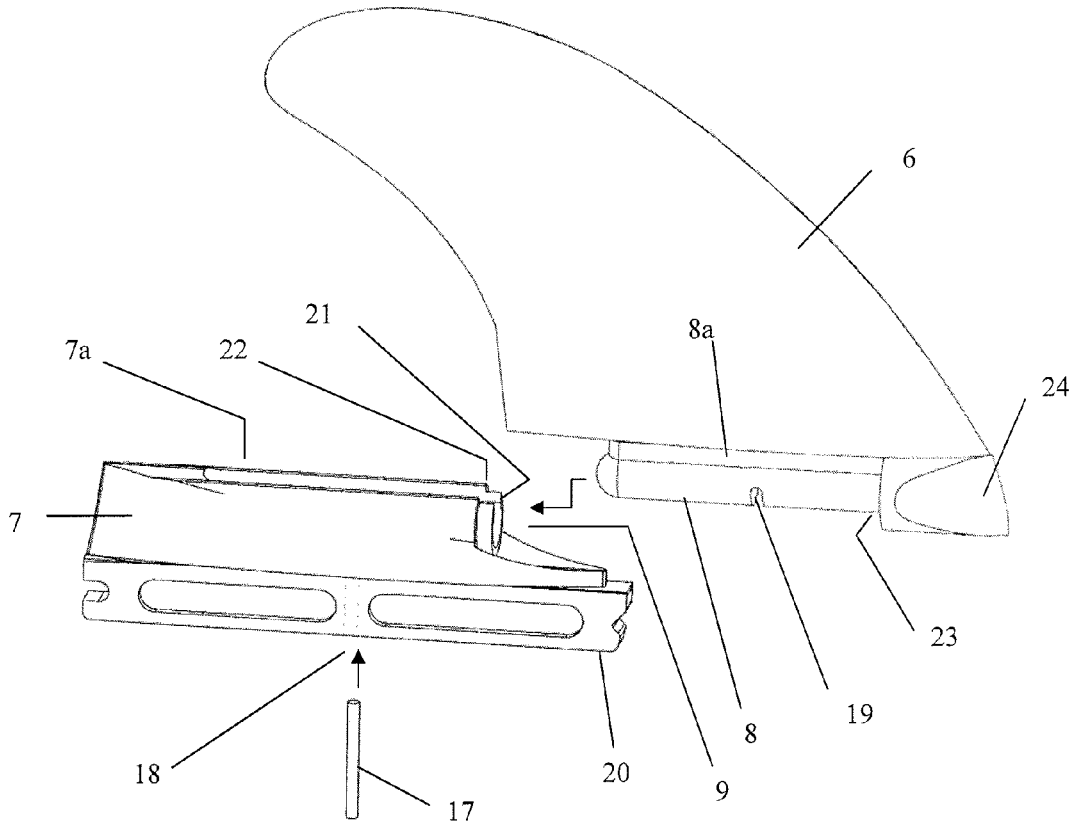
FIG. 6 shows an exploded view of the fin assembly secured together with a concealed-pin having a longitudinal axis.
Figure 7:
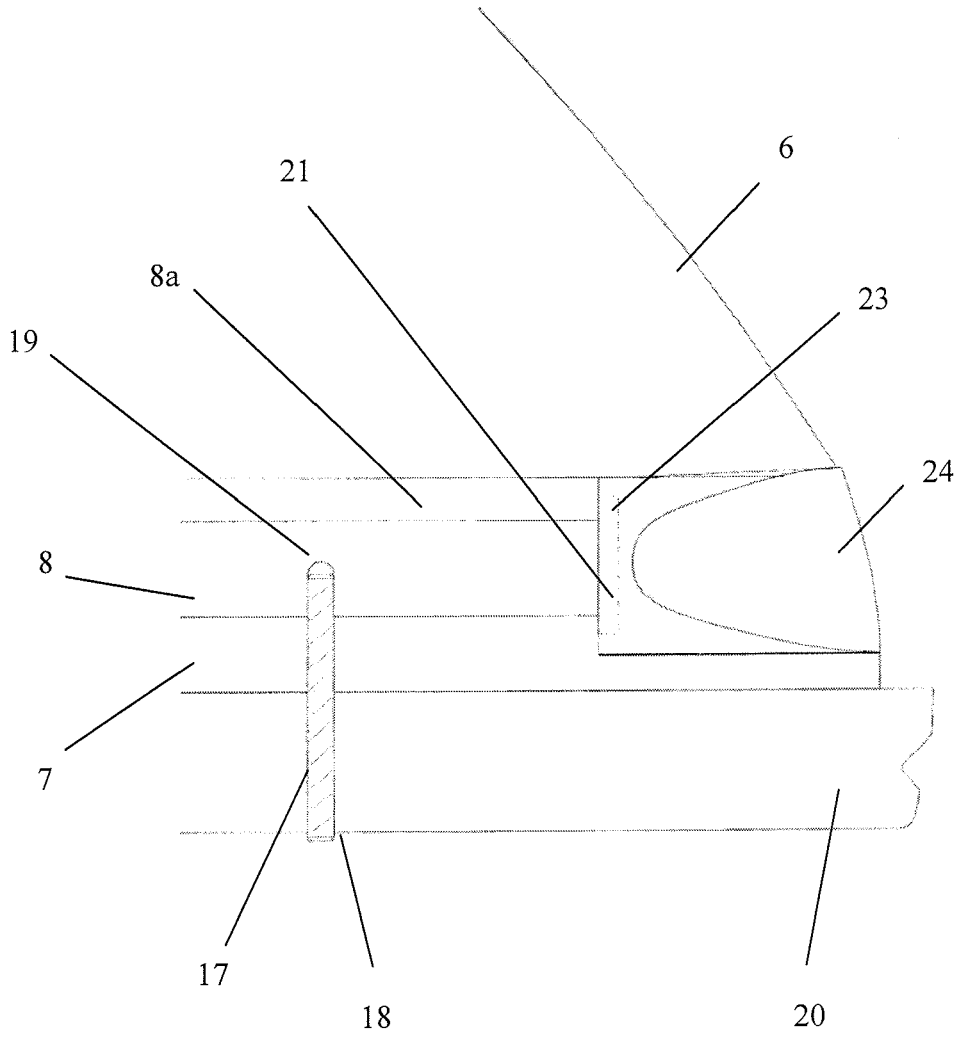
FIG. 7 shows a detail of the concealed-pin having a mechanism for securing the components.

FIGS. 6 and 7 show an additional embodiment of the fin assembly utilizing longitudinal members, such as a "concealed-pin" having a longitudinal axis to attach the fin 6 to the base 7. The fin portion 6 includes the cylindrical hinge 8 inserted into the base hinge opening 9. The fin portion 6 is secured to the base portion 7 by a close tolerance fit that structurally connects the two components together while allowing the fin portion 6 to freely rotate, similar to the hinge of a door. Similar to the embodiment shown in FIG. 3, the longitudinal projection 8*a* fits into the slot 7*a* of the base 7 when the hinge 8 is inserted into the base hinge opening 9. In this embodiment the concealed pin or fastener 17 having a longitudinal axis is placed through an aligning hole 18 (shown in dotted lines in FIG. 6) located in the bottom of a Future Style Mounting System 20. The mounting system 20 secures the base portion 7 to the underside of the surfboard. This bottom area of the base portion 7 is typically concealed within the mounting box (not shown) of the typical removable fin system, such as the most popular FCS and Future Fin Systems. During assembly of the pivoting fin of the present invention, the fin portion 6 and the base portion 7 are joined together by pushing the cylindrical hinge 8 inside of the base hinge opening 9. The assembly is then secured together by pushing the concealed pin 17 having a longitudinal axis through the aligning hole 18 in the base portion 7. The aligning hole 18 is perfectly aligned with a receiving slot 19 located in the cylindrical hinge 8 area of the fin potion 6. The aligning hole 18, the slot 19 and the pin 17 having a longitudinal axis can all be threaded to assist in inserting the pin 17 having a longitudinal axis through the hole 18 and into the slot 19.

As shown in FIG. 6 an underlapping extension 21 extends from a bearing face 22 at the entry of the base hinge opening 9 portion of the base slot portion 7*a*. This underlapping extension 21 fits precisely into an overlapping cavity 23 shown in FIGS. 7 and 8. When the fin portion 6 is inserted into the base portion 7, enough clearance is provided between the slot 7*a* and the projection 8*a* to allow movement However, when the fin portion 6 is loaded due to the pressure of the water against the fin portion 6, the overlapping cavity 23 applies a securing compressive load on the underlapping extension 21. A restraining compressive load is applied to the front end of the base hinge opening 9 that adds considerable structural integrity to the assembly. When the fin portion 6 is loaded by the hydrodynamic force of water impinging on the surface of the fin portion 6, the bending movements (torque) on the fin portion 6 act to expand the opening 9, particularly in the area of the bearing face 22. The overlapping cavity 23 prevents the opening 9 from expanding by applying the compressive load. When the fin portion 6 is not loaded, there are no bending movements (torque) on the fin portion 6, and the fin portion 6 freely rotates from one extreme to the other. This amount of rotation is approximately 7° from the center in each direction, a total rotation of 14°. Both the cavity 23 and the extension 21 are approximately 0.1 inches in length.

Figure 8:
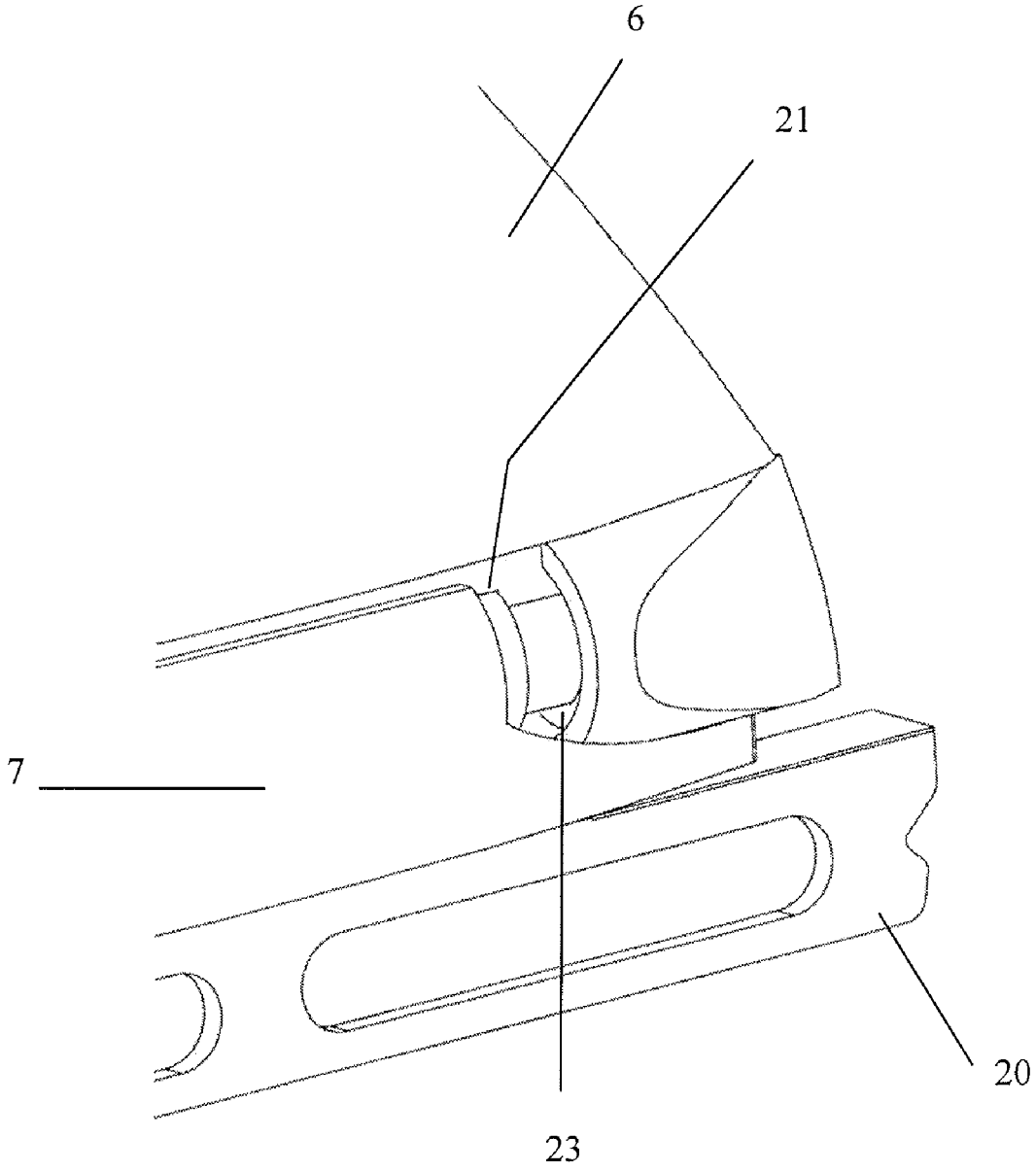
FIG. 8 shows a detail of the "structural overlap" mechanism of reinforcing the fin assembly.

The mechanism of securing the fin portion 6 to the base portion 7, with the fixed concealed pin 17 having a longitudinal axis, the underlapping extension 21 and overlapping cavity 23, as shown in FIGS. 6, 7 and 8 provide a structurally advantageous mechanism to handle the expected forces encountered when surfing, and at the same time provides a hydrodynamically beneficial profile and cross section. The concealed pin 17 having a longitudinal axis can be in the form of any type of pin, dowel, or fastener, including a threaded fastener, rivet, pan-head or button head fastener, or a specially formed tee-headed screw or fastener.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

The invention claimed is:

1. An assembly for pivotally attaching a fin in the roll axis with respect to a surfboard, the assembly comprising:

a rotatable hinge attached to the bottom of the fin;

a hollow base portion attached to the bottom of the surfboard, said hollow base portion provided with an opening on one end into which said rotatable hinge is longitudinally inserted; and a mechanism for movably attaching said rotatable hinge to said hollow base portion, said mechanism comprising a hollowed-out portion in said rotaple hinge, a bushing movably secured in said hollowed-out portion, and a first fastener connecting said hollow base portion to said bushing; wherein when hydrodynamic force is applied to one side of the fin, the fin will rotate in the roll axis due to rotatable movement of said rotatable hinge within said hollow base portion.

2. The assembly in accordance with claim 1, wherein said bushing is provided with a hole into which said fastener is inserted.

3. The assembly in accordance with claim 2, wherein both said fastener and said hole are threaded.

4. The assembly in accordance with claim 1, wherein said rotatable hinge is provided with a longitudinal projection and said hollow base portion is provided with a longitudinal slot, wherein said longitudinal projection is accommodated within said longitudinal slot.

5. The assembly in accordance with claim 4, further including short projections provided in said hollowed-out portion for constraining the rotatable movement of said bushing between two extreme positions.

6. The assembly in accordance with claim 4, wherein said bushing is constructed from an elastomeric rubber material for dissipating the energy of said bushing as it moves between said two extreme positions.

7. The assembly in accordance with claim 1, wherein said mechanism includes a slot provided in said rotatable hinge and a second fastener connecting said hollow base portion to said slot of said rotatable hinge, said second fastener passing through a hole provided in said hollow base portion.

8. The assembly in accordance with claim 7, wherein said rotatable hinge is provided with a longitudinal projection and said hollow base portion is provided with a longitudinal slot, wherein said longitudinal projection is accommodated within said longitudinal slot.

9. The assembly in accordance with claim 8, wherein said rotatable hinge includes a cavity at one end of said longitudinal projection, and further wherein one end of said longitudinal slot is provided with an extension portion, said extension portion inserted into said cavity when said rotatable hinge is fully inserted into said hollow base portion.

10. The assembly in accordance with claim 9, wherein said extension is approximately 0.1 inch in length.

11. The assembly in accordance with claim 7, wherein said slot, said fastener and said hole are threaded.

12. The assembly in accordance with claim 1, wherein one end of said rotatable hinge is provided with a slot, and further wherein an elastomeric material is provided in said slot.

13. The assembly in accordance with claim 1, wherein said fastener is a pin, dowel or rivet.

14. The assembly in accordance with claim 7, wherein said fastener is a pin, dowel or rivet.

15. The assembly in accordance with claim 1, wherein said fin rotates in the range of 0° to 14°.

16. An assembly for pivotally attaching a fin in the roll axis with respect to a surfboard, the assembly comprising:

a rotatable hinge attached to the bottom of the fin;

a hollow base portion attached to the bottom of the surfboard, said hollow base portion provided with an opening on one end into which said rotatable hinge is longitudinally inserted; and a mechanism for movably attaching said rotatable hinge to said hollow base portion, said mechanism including a slot provided in said rotatable hinge, and a fastener connecting said hollow base portion to said slot of said rotatable hinge, said fastener passing through a hole in said hollow base portion; wherein when hydrodynamic force is applied to one side of the fin, the fin will rotate in the roll axis due to rotatable movement of said rotatable hinge within said hollow base portion.

17. An assembly for pivotally attaching a fin in the roll axis with respect to a surfboard, the assembly comprising:

a rotatable hinge attached to the bottom of the fin, one end of said rotatable hinge provided with a slot;

an elastomeric material provided in said slot;

a hollow base portion attached to the bottom of the surfboard, said hollow base portion provided with an opening on one end into which said rotatable hinge is longitudinally inserted; and a mechanism for movably attaching said rotatable hinge to said hollow base portion; wherein when hydrodynamic force is applied to one side of the fin, the fin will rotate in the roll axis due to the rotatable movement of said rotatable hinge within said hollow base portion.

* * * * *